US007291099B1

(12) United States Patent
Marczewski

(10) Patent No.: US 7,291,099 B1
(45) Date of Patent: Nov. 6, 2007

(54) PORTABLE FITNESS DEVICE

(76) Inventor: George B. Marczewski, 17W763 Lowell La., Villa Park, IL (US) 60181

( * ) Notice: Subject to any disclaimer, the term of this patent is extended or adjusted under 35 U.S.C. 154(b) by 112 days.

(21) Appl. No.: 11/148,705

(22) Filed: Jun. 9, 2005

(51) Int. Cl.
*A63B 21/012* (2006.01)

(52) U.S. Cl. ..... 482/114; 482/120; 482/148

(58) Field of Classification Search ..... 482/114, 482/39–40; 234/389; 294/85, 82.13; 188/65.4, 188/65; 182/5–9, 72, 42, 193
See application file for complete search history.

(56) References Cited

U.S. PATENT DOCUMENTS 785,019 A 3/1905 Parker
3,217,840 A 11/1965 Holkesvick
3,472,510 A 10/1969 Holkesvick
3,510,132 A 5/1970 Holkesvick
3,656,745 A 4/1972 Holkesvick
3,782,722 A 1/1974 Webb
4,343,466 A * 8/1982 Evans ..... 482/120
4,466,612 A * 8/1984 Marczewski ..... 482/120
4,723,634 A * 2/1988 Fisk ..... 188/65.4
5,352,172 A 10/1994 Suzaki
5,467,845 A * 11/1995 Scruggs ..... 188/65.2
5,556,368 A 9/1996 Akin
5,803,209 A 9/1998 Suzaki
5,896,157 A * 4/1999 Fisher, Sr. ..... 347/171
6,102,837 A * 8/2000 Hubbard ..... 482/120

* cited by examiner

*Primary Examiner*—Lori Amerson
(74) *Attorney, Agent, or Firm*—Robert J. Harter

(57) ABSTRACT

A variable resistance exercising device is described for doing isometric, isotonic and isokinetic exercises. The device includes a unitary, tortuous rod, which is shaped to include at least one mandrel for receiving several turns of a rope, a first loop for receiving the rope near one end of the mandrel, and an overlapping curl for receiving both the rope and an adjustably mountable anchor strap at an opposite end of the mandrel. The shape of the rod is such that there are no tight radius curves. Also, the rod creates a cord-receiving throat that allows the rope to be readily inserted and removed; yet the throat inhibits the rope from falling out from within the loop when tension in the rope is released.

20 Claims, 5 Drawing Sheets

PORTABLE FITNESS DEVICE

BACKGROUND OF THE INVENTION

1. Field of the Invention

The subject invention generally pertains to exercising devices and more specifically to a portable device that employs a selectable number of wraps for adjusting the device's frictional resistance.

2. Description of Related Art

Various portable fitness devices have been developed in the past. Perhaps one of the best ones is disclosed in U.S. Pat. No. 4,466,612, which is specifically incorporated by reference herein.

Although the device disclosed in the '612 patent offers several advantages over other available devices, the '612 device does have some drawbacks. First, the rope to which the handles are attached can slip off the lower loops of the device when the rope slackens. Second, the unitary bar includes several tight radius bends, which can be difficult to form without leaving kinks or marks in the surface of the bar. If such marks are not removed, they can cut the rope when the device is in use.

Consequently, a need exists for an improved portable fitness device that overcomes the problems of current devices.

SUMMARY OF THE INVENTION

To provide a superior portable fitness device, an object of some embodiments of the invention is to provide a unitary rod that is formed in a tortuous shape to create at least one overlapping curl that facilitates the installation and removal of a pliable elongate member such as a rope, cord, strap, cable, etc.

Another object of some embodiments is to provide a unitary rod that defines a restricted passageway through which the pliable elongate member can be forced, whereby the pliable elongate member does readily fall out on its own.

Another object of some embodiments is to create the restricted passageway at a location that is spaced apart from the very end of the unitary rod, thereby avoiding sharp edges that may exist at the end of the rod.

Another object of some embodiments is to form a portable fitness device from a unitary rod of a substantially uniform diameter so that the rod can be readily formed using conventional and N/C forming machines.

Another object of some embodiments is to produce a portable fitness device from a unitary rod that does not include any tight bends that are difficult to form.

Another object of some embodiments is to provide the formed unitary rod with a surface finish of at least 120 microinches, and preferably 250 microinches or more, to ensure ample frictional drag without having to wrap the pliable elongate member an excessive number of turns around the rod.

Another object of some embodiments is to provide a pliable elongate member with handles at each end that can be left on while inserting, adjusting or removing the pliable elongate member from the unitary rod.

Another object of some embodiments is to enable a user to adjustably anchor a portable fitness device between a door and a doorjamb and do so by using a flexible elongate anchor that is sufficiently soft to avoid damaging the door.

Another object of some embodiments is to provide a pliable elongate member that can be selectively attached or removed from a unitary bar without having to untie or unbuckle the elongate member.

One or more of these and/or other objects of the invention are provided by an exercise device that includes two pliable elongate members that are attached to a unitary rod. The rod has a tortuous shape to define a restricted passageway through which at least one of the elongate members can be forced.

DESCRIPTION OF THE PREFERRED EMBODIMENT

Figure 1:
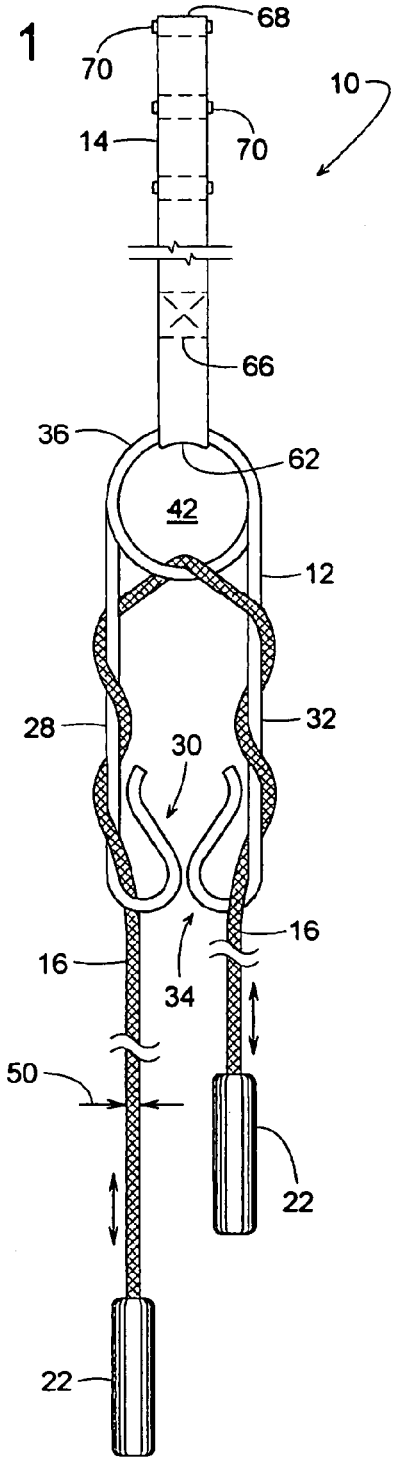
FIG. 1 is a front view of an exercise device according to one embodiment of the invention.

An exercise device 10, shown in FIGS. 1-5, can be used in a manner similar to that of the device disclosed in U.S. Pat. No. 4,466,612; however, device 10 includes features not found in earlier devices. In some embodiments, device 10 comprises a unitary rod 12, a strap 14 and a cord 16. Strap 14 helps anchor rod 12 to a doorjamb 18 (FIG. 5) or some other convenient point, and cord 16 is threaded through and wrapped around rod 12 to create frictional drag between rod 12 and cord 16. The number of wraps can be varied to adjust the amount of friction. To exercise, a user 20 alternately pulls on handles 22 and while maintaining at least some tension at both ends of cord 16. The friction between rod 12 and cord 16 provides resistance that can be used in a wide variety of physical exercises.

The terms, "strap" and "cord" are defined herein as being equivalent and are thus used interchangeably. Both a "strap" and a "cord" represent any type of pliable elongate member. Examples of a strap include, but are not limited to, a belt, a rope, a cord, a fabric strip, a cable, etc. Likewise, examples of a cord include, but are not limited to, a belt, a rope, a strap, a fabric strip, a cable, etc. The terms, "strap" and "cord" are being used in the claims only to make the claims easier to read and understand, as the awkward alternative of using the terms, "a first elongate member" and "a second elongate member" would only add unnecessary confusion to the claims.

In some embodiments, rod 12 extends seamlessly from a first end 24 to an opposite end 26 to provide a unitary rod that comprises a first mandrel 28 with a first loop 30, a second mandrel 32 with a second loop 34, and an overlapping curl 36 interposed between mandrels 28 and 32.

Overlapping curl 36 comprises a first lap 38 and a second lap 40 that overlap each other such that curl 36 defines an eyelet 42 into which strap 14 and cord 16 may extend. Laps 38 and 40 may also define a strap-receiving passageway 44 therebetween such that strap 14 can be slipped through passageway 44 to selectively insert and remove strap 14 from within eyelet 42. Passageway 44 may be smaller than a strap thickness 46 of strap 14 so that in order to install strap 14 by sliding it through passageway 44, strap 14 may need to be forced between laps 38 and 40 to encircle at least one of the laps. In cases where laps 38 and 40 are tightly up against each other, passageway 44 can still exist by virtue of rod 12 having sufficient flexibility to allow laps 38 and 40 to be momentarily forced apart to receive strap 14.

First loop 30 is adjacent to first mandrel 28 to define a first cord-receiving throat 48 between loop 30 and mandrel 28. The cord-receiving throat is defined as the minimum radial distance between the loop and its adjacent mandrel, wherein the radial distance is in reference to the radius or diameter of the rod itself (not the radius along which the rod is bent). Throat 48 is preferably smaller than a cord thickness 50 of cord 16 so that once cord 16 is forcibly slid through throat 48 and into loop 30, cord 16 does not readily fall back out. Likewise, second loop 34 is adjacent to second mandrel 32 to define a second cord-receiving throat 52 between loop 34 and mandrel 32. Throat 52 is also preferably smaller than cord thickness 50 so that once cord 16 is forcibly slid through throat 52 and into loop 34, cord 16 does not readily fall back out. In some cases, the loop and adjacent mandrel are tightly up against each other, whereby forcing the two apart creates the throat. The flexibility of cord 16 and/or rod 12 enable the larger cord to be forced through the smaller throat.

Figure 3:
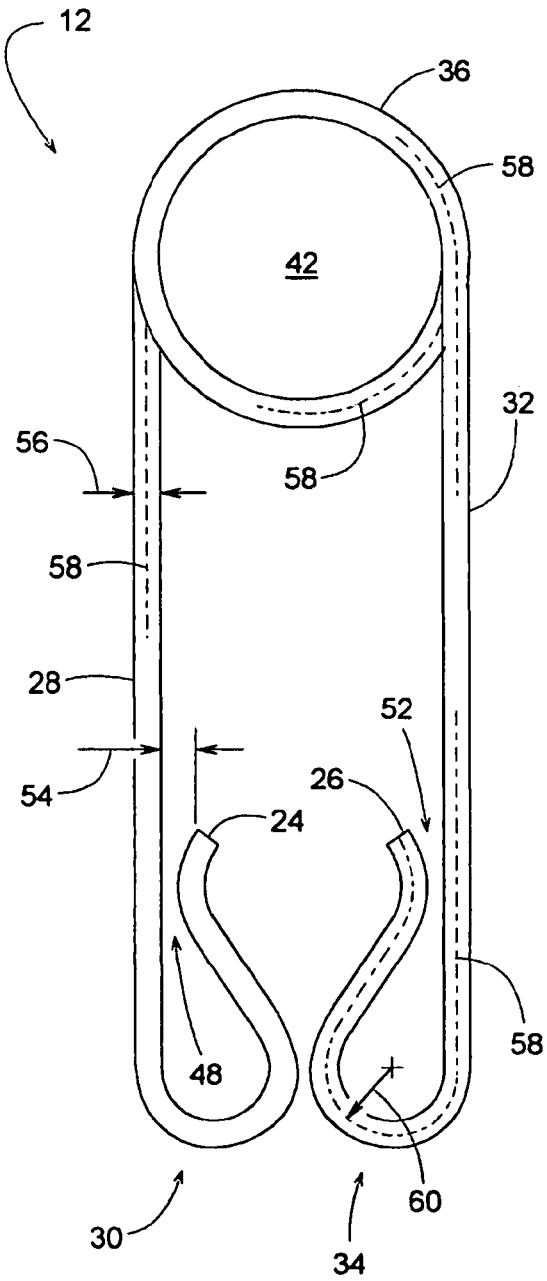
FIG. 3 is a front view of a unitary rod used in the device of FIG. 1.
Figure 4:
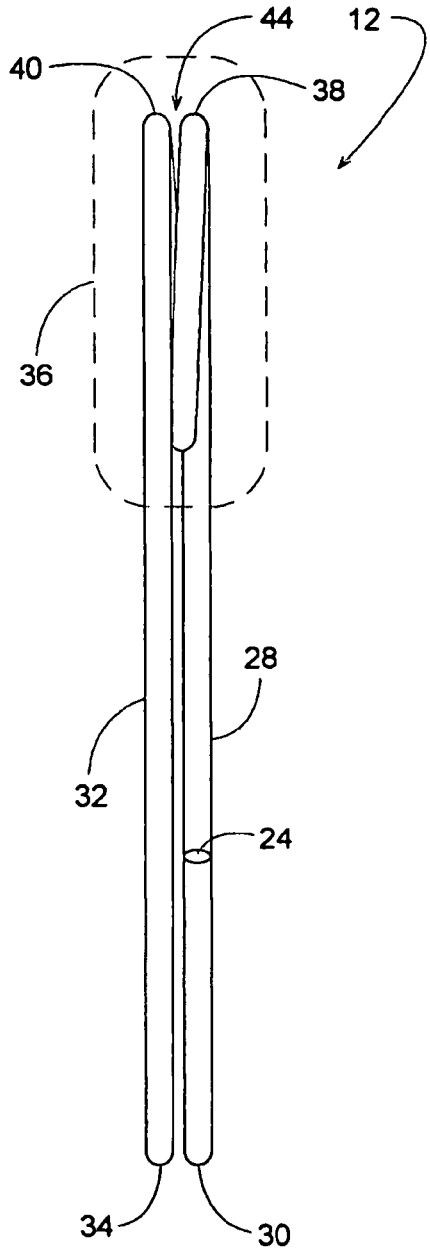
FIG. 4 is a side view of FIG. 3.

In some cases, as shown in FIG. 3, first throat 48 is positioned a short distance from end 24 of rod 12 so that if a sharp edge exists at end 24, that edge will be less likely to snag cord 16 as the cord is being inserted into first loop 30. Thus, a lead-in for cord 16 is created by positioning end 24 a spaced distance 54 from first mandrel 28, wherein distance 54 is greater than throat 48 (i.e., distance 54 is greater than the distance between loop 30 and mandrel 28 at throat 48). The same applies to second loop 34, second mandrel 32 and second throat 52.

To facilitate manufacturing, rod 12 has a substantially uniform diameter 56 along substantially the entire length of the rod. In addition, a tortuous longitudinal centerline 58 extending along a full length of rod 12 has a minimum radius of curvature 60 that is at least twice as large as diameter 56, and is preferably at least three times as large as diameter 56. The relatively large radius of curvature provides rod 12 with a smoothly curved surface along its full length, which makes rod 12 easy to form without creating kinks or other sharp edges in the rod.

To create ample frictional drag between cord 16 and rod 12 without having to use an excessive number of wraps, rod 12 preferably has a satin or roughened surface finish of at least 120 microinches, and preferably 250 microinches or more, wherein the microinch value is the average deviation from the mean surface as well understood by those of ordinary skill in the art of surface finishes. In some cases, a surface finish of 500 or even a 1,000 microinches may provide positive results. Such surface finishes can be accomplished by various ways including, but not limited to, machining, knurling, or sand blasting the surface of rod 12.

Figure 2:
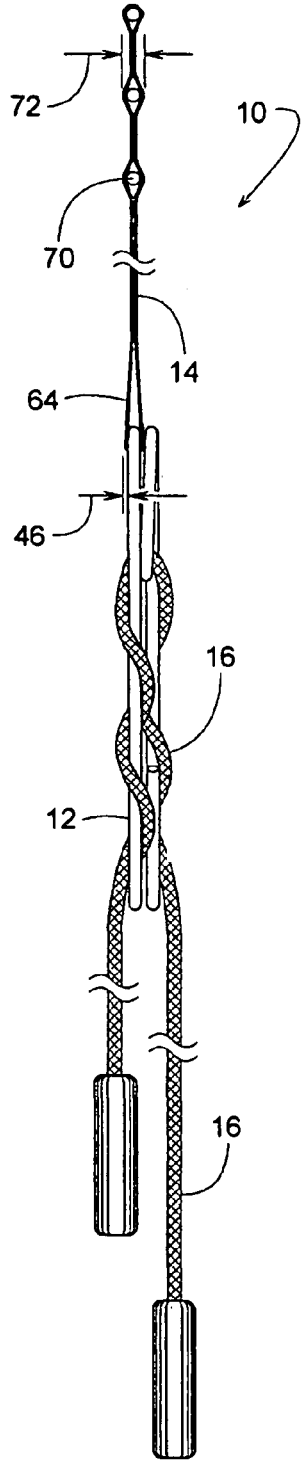
FIG. 2 is a side view of FIG. 1.

To render strap 14 removable from rod 12, a first end 62 of strap 14 can be provided with a strap loop 64 that can slip over loop 30 or 34 and slide through strap-receiving passageway 44 to the position of FIGS. 1 and 2 so that strap loop 64 can engage either lap 38 or 40. For a more permanent connection, strap 14 can be wrapped around both laps 38 and 40 and subsequently sewn at a seam 66 to create a strap loop that is not readily removable.

Figure 5:
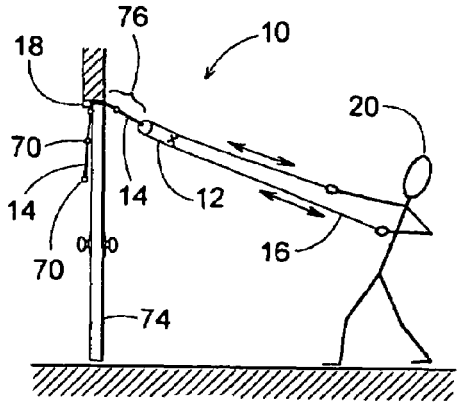
FIG. 5 is a schematic view showing the use of the exercise device of FIG. 1.

To enable a second end 68 of strap 12 to be adjustably anchored to a doorframe, strap 14 contains a plurality of flexible elongate anchors 70 that provide strap 14 with an enlarged strap thickness 72 at each anchor 70. Strap 14 can be held pinched between a door 74 and its doorjamb 18, as shown in FIG. 5. The thickness of anchors 70 prevents strap 14 from pulling out from within the doorjamb, and the multiple anchors 70 provide a means for selectively adjusting an effective length 76 of strap 14. Anchors 70 can be made of neoprene tubing or some other relatively soft material to avoiding damaging the surface of door 74 or doorjamb 18.

It should be appreciated that unitary rod 12 can assume an infinite variety of other configurations while still remaining within the spirit of the invention. Some alternate configurations, for example, are shown in FIGS. 6-13.

Figure 6:
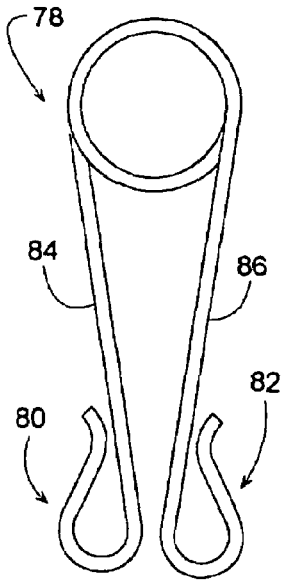
FIG. 6 is a front view similar to FIG. 3 but showing another rod embodiment.

A unitary rod 78 of FIG. 6 is similar to rod 12; however, loops 80 and 82 protrude outward rather than inward, and mandrels 84 and 86, which correspond to mandrels 28 and 32, are set at an angle to each other.

Figure 7:
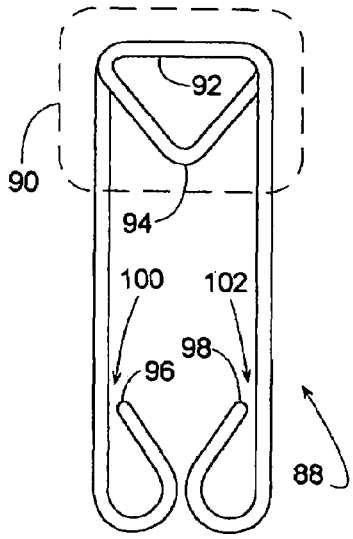
FIG. 7 is a front view similar to FIG. 3 but showing another rod embodiment.

A unitary rod 88 of FIG. 7 is similar to rod 12; however, an overlapping loop 90 has a more triangular shape with a flat upper section 92 that is suitable for engaging a wide strap, and a more pointed lower section 94 this is suitable for engaging a narrower cord. Also in this example, the very ends 96 and 98 of rod 88 help define throats 100 and 102.

Figure 8:
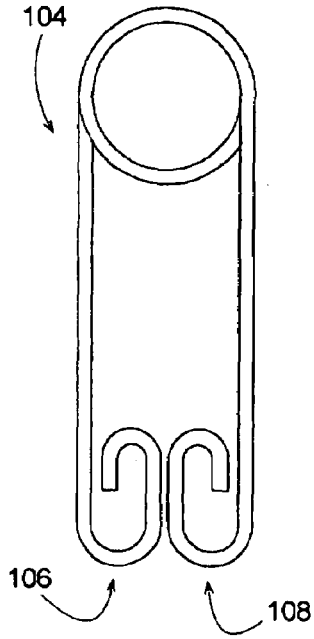
FIG. 8 is a front view similar to FIG. 3 but showing another rod embodiment.

In FIG. 8, a unitary rod 104 has yet another shape for creating loops 106 and 108.

Figure 9:
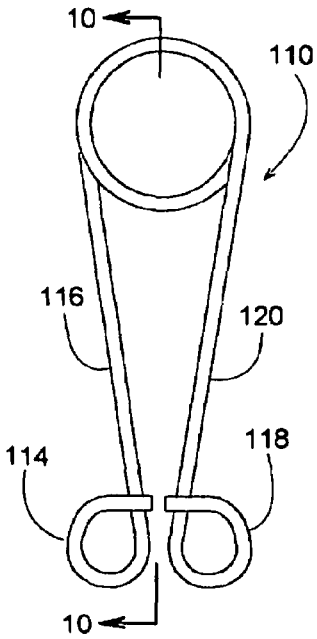
FIG. 9 is a front view similar to FIG. 3 but showing another rod embodiment.
Figure 10:
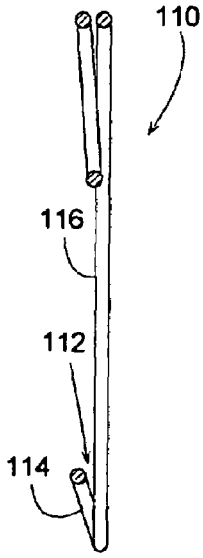
FIG. 10 is a cross-sectional view taken along line 10-10 of FIG. 9.

A unitary rod 110 of FIGS. 9 and 10 provides a particularly novel way of creating a cord-receiving throat 112. In this example, loop 114 overlaps its adjacent mandrel 116 to create throat 112 therebetween that is smaller than cord thickness 50. Loop 118 and mandrel 120 are formed in a similar manner.

Figure 11:
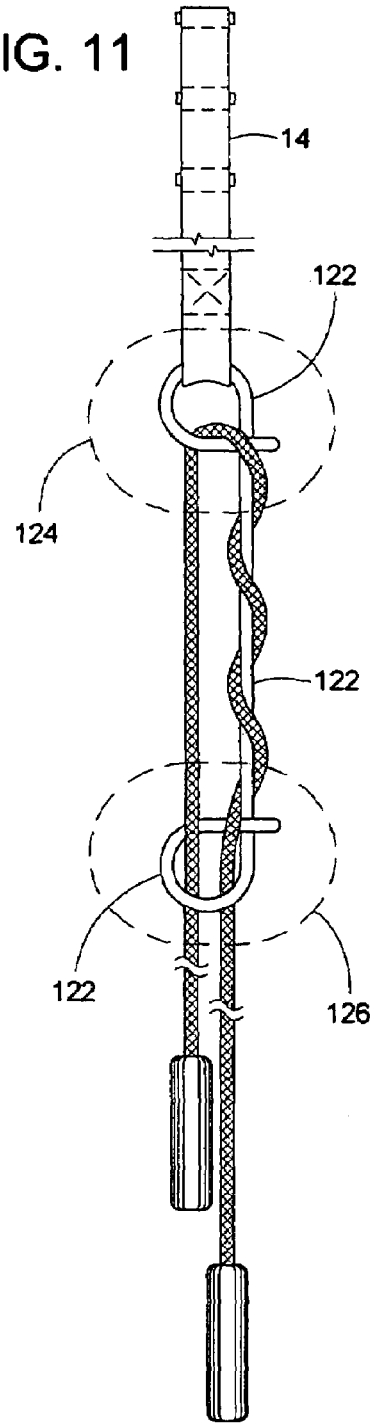
FIG. 11 is a front view similar to FIG. 1 but showing another embodiment of an exercise device.
Figure 12:
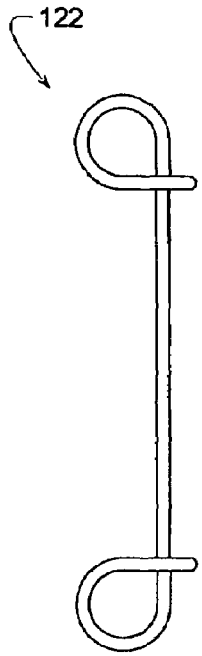
FIG. 12 is a front view of a rod used in the exercise device of FIG. 11.
Figure 13:
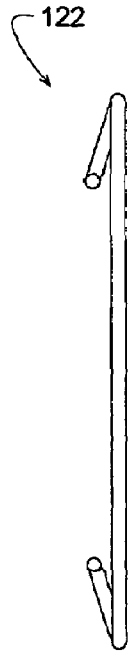
FIG. 13 is a side view of FIG. 12.

In another embodiment, shown in FIGS. 11-13, a unitary rod 122 includes an overlapping curl 124 and a loop 126, which are both formed similar to loop 114 of FIGS. 9 and 10.

Figure 14:
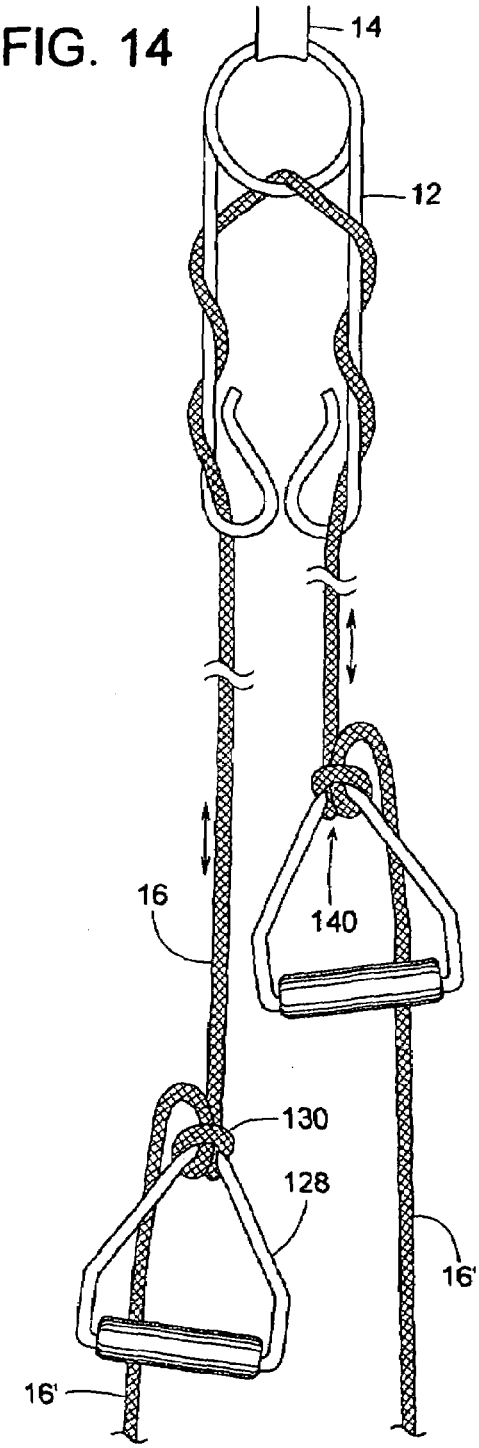
FIG. 14 is a front view of another embodiment.

The embodiment of FIG. 14 shows how a handle 128 can be attached to cord 16 by using a releasable knot 130. Knot 130 allows one to adjust the active portion of cord 16 that extends between the two handles. Being able to adjust the active cord length allows one to use the exercise device for a greater variety of exercises. When the active cord length is relatively short, the extra cord 16' can simple drape beyond handles 28. Knot 130 can be any suitable knot and not just limited to the one shown. The knot shown in FIG. 14 is known as a Lark's Head Hitch, a Cow Hitch, or a Lanyard Hitch. It should be noted that an apex 140 of handle 128 provides an angle of convergence that creates a crevice that is narrower than the diameter of cord 16, whereby the crevice pinches cord 16 to help hold knot 130 together.

Figure 15:
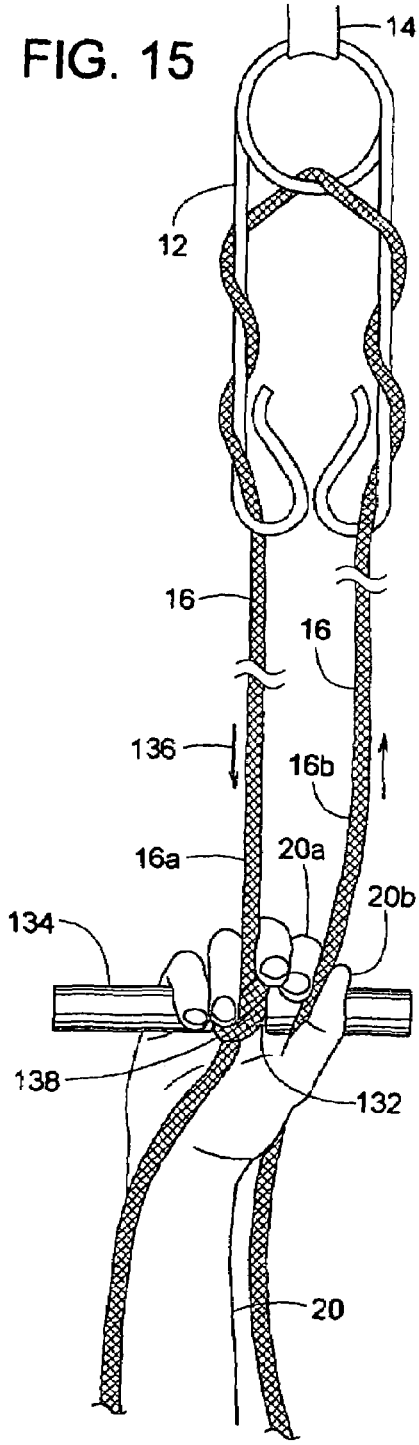
FIG. 15 is a front view of yet another embodiment.

In yet another embodiment, shown in FIG. 15, cord **16*a* is tied or wrapped around a centrally located groove 132 of a handle 134. Any appropriate knot 138 can be used such as, for example, a Clove Hitch, Overhand Knot, or Thumb Knot. To maintain tension in cord 16*b* as user 20 pulls handle 134 in direction 136, user 20 can pinch cord 16*b*** between the user's finger 20*a* and thumb 20*b*. Varying the pinching force against cord 16*b* varies the force required to pull handle 134 in direction 136. Adjusting the location of knot 138 along the length of cord 16 provides a way of adjusting the active length of cord 4 or the distance between handle 34 and device 12.

Although the invention is described with reference to a preferred embodiment, it should be appreciated by those of ordinary skill in the art that various modifications are well within the scope of the invention. Therefore, the scope of the invention is to be determined by reference to the following claims.

The invention claimed is:

1. An exercise device, comprising:

a strap having a strap thickness;

a cord having a cord thickness; and a unitary rod that includes:

a) a first mandrel about which the cord can be wrapped to create frictional drag therebetween;

b) a first loop integrally extending from the first mandrel, wherein the first loop and the first mandrel define a first cord-receiving throat therebetween such that the first cord-receiving throat is smaller than the cord thickness when the cord and the unitary rod are substantially unstressed, yet the cord can be forced through the first cord-receiving throat to selectively insert and remove the cord from within the first loop; and c) an overlapping curl integrally extending from the first mandrel, wherein the overlapping curl comprises a first lap and a second lap that overlap each other such that the overlapping curl defines an eyelet into which the strap and the cord can extend, and the first mandrel is interposed between the overlapping curl and the first loop.

2. The exercise device of claim 1, wherein the unitary rod also includes:

a) a second mandrel about which the cord can be wrapped to create frictional drag therebetween, wherein the second mandrel integrally extends from the overlapping curl; and b) a second loop integrally extending from the second mandrel, wherein the second loop and the second mandrel define a second cord-receiving throat therebetween such that the second cord-receiving throat is smaller than the cord thickness when the cord and the unitary rod are substantially unstressed, yet the cord can be forced through the second cord-receiving throat to selectively insert and remove the cord from within the second loop, wherein the second mandrel is interposed between the overlapping curl and the second loop.

3. The exercise device of claim 1, wherein the unitary rod terminates at one end by the first loop, and the one end is spaced a distance away from the first mandrel, wherein the distance is greater than the cord-receiving throat.

4. The exercise device of claim 1, wherein the unitary rod has a substantially uniform diameter along substantially an entire length thereof.

5. The exercise device of claim 1, wherein the unitary rod has a tortuous longitudinal centerline extending along a full length thereof, wherein the tortuous longitudinal centerline has a minimum radius of curvature that is at least twice as large as a diameter of the unitary rod.

6. The exercise device of claim 1, wherein the first mandrel has a surface finish of at least 120 microinches.

7. The exercise device of claim 1, wherein the cord has two handles at opposite ends thereof.

8. The exercise device of claim 1, wherein the first lap and the second lap define a strap-receiving passageway therebetween such that the strap can be slipped through the strap-receiving passageway to selectively insert and remove the strap from within the eyelet.

9. The exercise device of claim 8, wherein the strap includes a strap loop that at least a portion of which can be slipped through the strap-receiving passageway to selectively couple and decouple the strap loop from at least one lap of the overlapping loop.

10. The exercise device of claim 1, wherein the strap includes a first end and a second end, and the first end is coupled to at least one lap of the overlapping curl and the second end contains a flexible elongate anchor that provides the strap with an enlarged strap thickness at the second end.

11. An exercise device, comprising:

a strap having a strap thickness;

a cord having a cord thickness; and a unitary rod that includes:

a) an overlapping curl comprising a first lap and a second lap that overlap each other such that the overlapping curl defines an eyelet into which the strap and the cord extend and the first lap and the second lap define a strap-receiving passageway therebetween such that the strap can be slipped through the strap-receiving passageway to selectively insert and remove the strap from within the eyelet;

b) a first mandrel integrally extending from the first lap;

c) a second mandrel integrally extending from the second lap, wherein the cord wraps around at least one of the first mandrel and the second mandrel to create frictional drag between the cord and the unitary rod;

d) a first loop integrally extending from the first mandrel, wherein the first loop and the first mandrel define a first cord-receiving throat therebetween such that the first cord-receiving throat is smaller than the cord thickness when the cord and the unitary rod are substantially unstressed, yet the cord can be forced through the first cord-receiving throat to selectively insert and remove the cord from within the first loop; and e) a second loop integrally extending from the second mandrel such that the second mandrel is interposed between the second lap and the second loop, wherein the second loop and the second mandrel define a second cord-receiving throat therebetween such that the second cord-receiving throat is smaller than the cord thickness when the cord and the unitary rod are substantially unstressed, yet the cord can be forced through the second cord-receiving throat to selectively insert and remove the cord from within the second loop, wherein the second mandrel is interposed between the overlapping curl and the second loop.

12. The exercise device of claim 11, wherein the unitary rod terminates at one end by the first loop, and the one end is spaced a distance away from the first mandrel, wherein the distance is greater than the cord-receiving throat.

13. The exercise device of claim 11, wherein the unitary rod has a substantially uniform diameter along substantially an entire length thereof.

14. The exercise device of claim 11, wherein the unitary rod has a tortuous longitudinal centerline extending along a full length thereof, wherein the tortuous longitudinal centerline has a minimum radius of curvature that is at least twice as large as a diameter of the unitary rod.

15. The exercise device of claim 11, wherein the first mandrel has a surface finish of at least 120 microinches.

16. The exercise device of claim 11, wherein the cord has two handles at opposite ends thereof.

17. The exercise device of claim 16, wherein the strap includes a strap loop that at least a portion of which can be slipped through the strap-receiving passageway to selectively couple and decouple the strap loop from at least one lap of the overlapping loop.

18. The exercise device of claim 11, wherein the strap includes a first end and a second end, and the first end is coupled to at least one lap of the overlapping curl and the second end contains a flexible elongate anchor that provides the strap with an enlarged strap thickness at the second end.

19. An exercise device, comprising:

a strap having a strap thickness and a strap loop;

a flexible elongate anchor connected to the strap such that the flexible elongate anchor provides the strap with an enlarged strap thickness in the vicinity of the flexible elongate anchor;

a cord having a cord thickness and two handles disposed at opposite ends of the cord; and a unitary rod having a substantially uniform diameter along a substantially full length thereof and having a tortuous longitudinal centerline extending along the substantially full length, wherein the tortuous longitudinal centerline has a minimum radius of curvature that is at least twice as large as the substantially uniform diameter, wherein the unitary rod also includes:

a) an overlapping curl comprising a first lap and a second lap that overlap each other such that the overlapping curl defines an eyelet into which the strap and the cord extend and the first lap and the second lap define a strap-receiving passageway therebetween such that the strap loop can be slipped through the strap-receiving passageway to selectively insert and remove the strap from within the eyelet;

b) a first mandrel integrally extending from the first lap;

c) a second mandrel integrally extending from the second lap, wherein the cord wraps around at least one of the first mandrel and the second mandrel to create frictional drag between the cord and the unitary rod;

d) a first loop integrally extending from the first mandrel, wherein the first loop and the first mandrel define a first cord-receiving throat therebetween such that the first cord-receiving throat is smaller than the cord thickness when the cord and the unitary rod are substantially unstressed, yet the cord can be forced through the first cord-receiving throat to selectively insert and remove the cord from within the first loop; and e) a second loop integrally extending from the second mandrel such that the second mandrel is interposed between the second lap and the second loop, wherein the second loop and the second mandrel define a second cord-receiving throat therebetween such that the second cord-receiving throat is smaller than the cord thickness when the cord and the unitary rod are substantially unstressed, yet the cord can be forced through the second cord-receiving throat to selectively insert and remove the cord from within the second loop, wherein the second mandrel is interposed between the overlapping curl and the second loop.

20. The exercise device of claim 19, wherein the unitary rod terminates at one end by the first loop, and the one end is spaced a distance away from the first mandrel, wherein the distance is greater than the cord-receiving throat.

* * * * *